United States Patent [19]

Meyer

[11] Patent Number: 4,764,740

[45] Date of Patent: Aug. 16, 1988

[54] PHASE SHIFTER

[75] Inventor: Maurice A. Meyer, Natick, Mass.

[73] Assignee: Micronav Ltd., Sydney, Canada

[21] Appl. No.: 83,247

[22] Filed: Aug. 10, 1987

[51] Int. Cl.[4] ..... H01P 1/185

[52] U.S. Cl. ..... 333/164; 333/103; 333/139; 333/156

[58] Field of Search ..... 333/156, 157, 160, 161, 333/164, 262, 263, 138, 139, 140, 245, 246, 1, 101, 103, 109, 115, 116, 118, 119, 104, 136, 137

[56] References Cited

U.S. PATENT DOCUMENTS 4,105,959 8/1978 Stachejko ..... 333/161

4,423,393 12/1983 Freitag et al. ..... 333/164

*Primary Examiner*—Marvin L. Nussbaum

*Attorney, Agent, or Firm*—Charles Hieken

[57] ABSTRACT

The present invention relates to a reflection diode phase shifter that achieves amplitude equality between phase shifts of incident energy. Amplitude equality is achieved by placing a resistor R to ground in parallel with the transmission lines connecting a four-port coupler to symmetric reflection terminators having an impedance that is varied by a diode. The resistor is placed at a point on the transmission line having the lowest voltage when the greatest power loss is realized by the phase shifter.

3 Claims, 1 Drawing Sheet

PHASE SHIFTER

The present invention relates to a diode phase shifter circuit which switches the transmission phase of incident energy by changing the reflection phase at a pair of reflection terminals of a particular four-port network. The four-port network is typically called a hybrid coupler because of its balanced properties and port isolation.

Among the types of hybrid couplers suitable for phase shifting are the branch line hybrid coupler, the rat race coupler and the proximity wave coupler. The operation of these phase shifters is described in "Semiconductor Control" by Joseph White, Artec Press, 437–50.

In a typical prior art circuit the phase shift between input and output branches is determined by impedances terminating the other branches selectively controlled by diode switches. However, differences in terminating impedances in the branches caused by the diode impedances being different in conducting and nonconducting states produces an unbalance that results in undesired amplitude modulation at the output.

The general feature of the invention is that amplitude disparity for a diode phase shifter circuit is corrected by equalizing the power losses for the different states of the diode.

Preferred embodiments of the invention include the following features. A resistor is placed to ground in parallel with each transmission line of a reflecting terminal at a low point of a standing wave while the diode is in a state having the highest power loss (the lossy state). The power loss as a result of the resistor in the nonlossy state is made equal to the losses of the lossy state by properly choosing the size of the resistor.

Other advantages and features will become apparent from the following specification when read in connection with the accompanying drawings in which.

Figure 1:
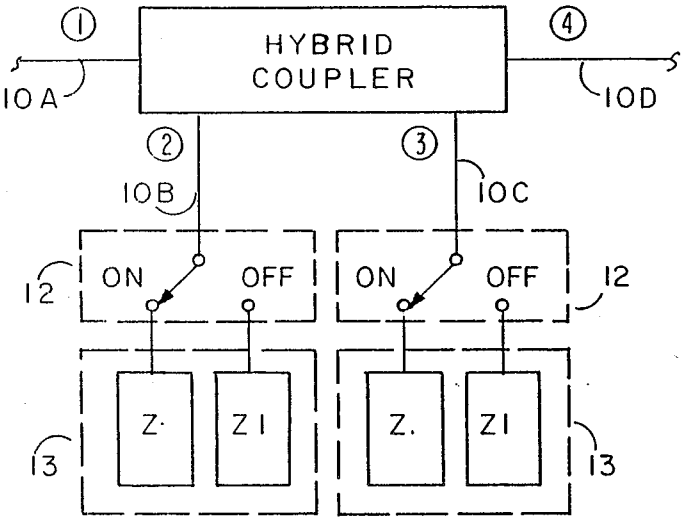
FIG. 1 is a block diagram illustrating a typical prior art four-port hybrid coupler phase shifter.

Referring to FIG. 1, a typical prior art four-port hybrid coupler is illustrated. Transmission lines 10A, 10B, 10C and 10D, each having a standard impedance such as 50 ohms are connected to input port 1, side port 2, side port 3, and output port 4, respectively. Transmission lines 10B and 10C couple side ports 2 and 3 through diode switches 12A and 12B, respectively, to respective ones of terminating impedances Z and $Z_1$.

If ports 2 and 3 are terminated in matched loads, the relative phase between the signals in these loads, for equal line lengths to the load, is either 90 or 180 degrees depending on the type of hybrid. When terminated by diodes 12A and 12B, respectively, and transmission lines 10B and 10C, respectively, which provide low loss reflecting terminations, energy incident at input port 1 is equally reflected from the reflective terminations of ports 2 and 3 to port 4, which is isolated from input port 1 when the side ports are terminated in matched loads.

Diodes 12A and 12B operate as switches for changing the impedance of the reflective termination. In the on state (conductive state) the terminating impedance Z is smaller than the terminating impedance Z1 when the diode is in the off state (nondconductive state) to provide corresponding different phase shifts in the reflected energy.

The required relationship between the two different terminating impedances is readily determined for a predetermined phase shift difference. The reflection coefficient of the termination at the transmission line for the on state of a diode is given by the standard formula for a reflection coefficient:

$$R=(Z-1)/(Z+1) \tag{1}$$

The impedance Z is the on-state termination impedance of the switch normalized to the transmission line impedance. R is then the reflection coefficient when the side port is terminated in Z with the diode conducting.

The reflection coefficient R1 from the normalized impedance Z1 for the off state of the switch is given by:

$$R1=(Z1-1)/(Z1+1) \tag{2}$$

For the case of a 180° phase shift, R1 must equal −R or $$(Z1-1)/(Z1+1)=(1-Z)/(1+Z)=(1/Z-1)/(1/Z+1) \tag{3}$$

Equation 3 implies that in order to obtain 180° phase shift the off-state impedance Z1 must be equal to the reciprocal of an on-state impedance Z. Similarly, other transmission phase shifters can be built with any variable reflection phase angle by properly calculating the termination impedance ratio between the on and off states.

Normally, however, the diode switch has some resistance associated with it which differs between the on and off states. The differences in resistance between the two states results in an amplitude disparity at output port 4 even though the phase may be correct.

By adding a proper length of external line to the output side of the diode when the diode conducts and the switch is closed, the input side of the diode will exhibit a reflection phase shift of 180°. Because of the diode resistances, the impedance relationship between conducting and nonconducting states will not have precisely reciprocal magnitudes. However, since the series resistance is much smaller than the line impedance (typically 0.02×the line impedance), the impedance magnitudes in conducting and nonconducting states are close to being reciprocal, and the phase shift can still be 180° if the reflection coefficients have unequal magnitudes upon adjusting the termination reactance. Typically values of the termination reactance magnitude as measured at the diode input reference plane vary between 1 and 3 in the switch-off state. The reflection coefficient in either state is greater than 0.95.

Since lines 10B and 10C to which diode switches 12A and 12B are connected have large reflected waves, there is a large standing wave ratio on these lines. It has been discovered that by locating the minimum of the standing wave on this line by calculation, such as with a Smith chart, or experimentally, for the on state, there is determined an especially convenient location for maintaining balance with the addition of relatively little additional structure to significantly reduce undesired amplitude modulation with negligible power loss.

At this minimum the impedance in the on state is very low. Because of the reciprocal relation between the impedances in the on and off states, the impedance in the off state is very high at this point. By adding a resistor to ground in parallel with each of lines 10B and 10C at this minimum, the effect of the resistor on additional loss in the on state is negligible while the loss in the off state may be made equal by proper choice of the shunting resistor. The invention thus provides substantially equal attenuation in both on and off states with negligible increase in loss of the already lossy state to significantly reduce the undesired amplitude modulation with negligible increase in attenuation.

Figure 2:
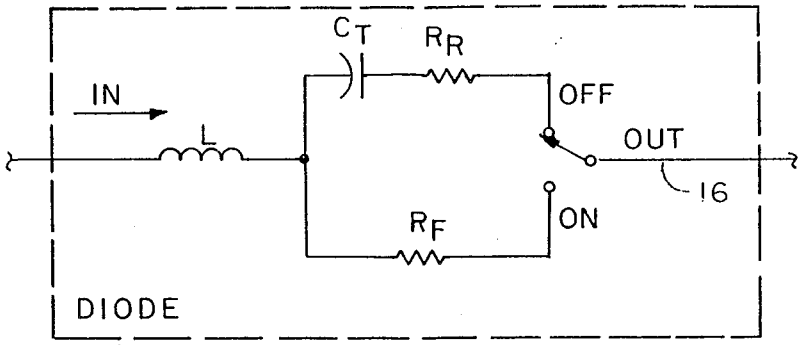
FIG. 2 is an equivalent circuit representation of a diode.

Referring to FIG. 2, an equivalent circuit of a diode switch is shown. In the off state, the diode lead inductance L is in series with the diode charge barrier capacitance $C_T$ and the reverse-biased resistance $R_R$. In the on state, the diode inductance L is in series with the forward-biased resistance $R_F$. Characteristically, the diode in the on state has a very low series resistance, typically 0.02 of the line impedance. In the off state, the effective series resistance is characteristically much lower.

Figure 3:
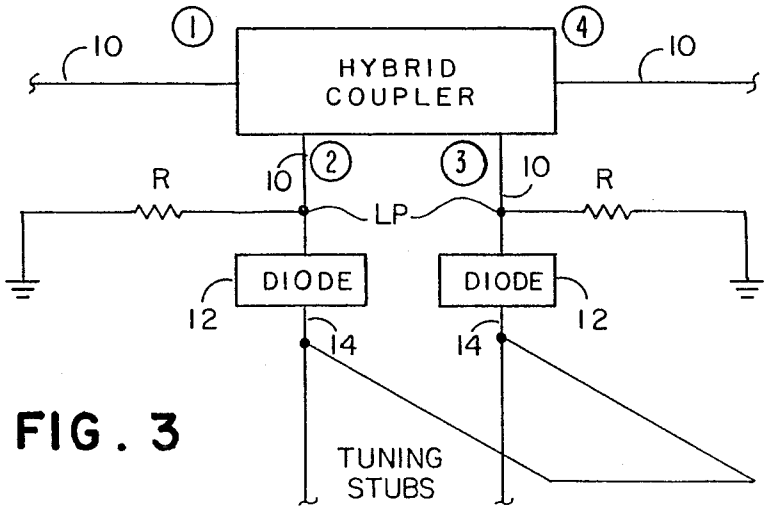
FIG. 3 is a block diagram of a four-port hybrid diode phase shifter coupler embodying the present invention.

Referring to FIG. 3, there is shown an exemplary embodiment of the invention. Tuning stubs 14A and 14B are connected to output terminals 16 (FIG. 2) of diodes 12A and 12B, respectively. Resistors 17A and 17B are connected between low points 18A and 18B, respectively, of transmission lines 10B and 10C, as noted above, the value of each of these resistors is chosen so that the power losses in the impedances presented by the branches connected to side ports 2 and 3 are substantially equal when diodes 12A and 12B are in the nonconducting state.

The principles of the invention are applicable to other bits in the phase shifter producing different magnitudes of phase shift. Although the magnitudes of the impedances are not reciprocally related in on and off states for the lower phase shift values, there is a magnitude difference in effectively terminating side ports so at the low point of the standing wave for one state, there exists a minimum in the standing wave ratio where a resistor may be added to provide minimum unbalance between the on and off states and thereby significantly reduce amplitude modulation.

Other embodiments are within the following claims:

What is claimed is:

1. In a hybrid coupler phase shifter having an input port, an output port, first and second side ports, and first and second means for coupling first and second diodes to said first and second side ports respectively, the improvement comprising, first and second resistive means coupled to said first and second means for coupling respectively for reducing unbalance in the impedances coupled to said first and second side ports when said diodes shift between conducting and nonconducting states to significantly reduce the amplitude modulation on a signal at said output terminal wherein said first and second means for coupling each comprise a transmission line having a standing wave thereon characterized by a low point thereon at which said standing wave ratio is a minimum, and means for connecting the first and second resistive means to said low points on said first and second transmission lines, respectively.

2. The improvement in accordance with claim 1 wherein each of said diodes is characterized by a forward resistance and the resistance of said resistive means establishes the power losses in the impedances coupled to said first and second side ports substantially equal when said diodes are in the nonconducting state.

3. The improvement in accordance with claim 2 and further comprising, first and second tuning stubs connected to said first and second diodes, respectively.

* * * * *